US007308193B2

(12) United States Patent
Halsall

(10) Patent No.: US 7,308,193 B2
(45) Date of Patent: Dec. 11, 2007

(54) NON-METALLIC HEATING ELEMENT FOR USE IN A FLUID HEATER

(76) Inventor: Richard Halsall, 6370 Forest Grove Dr., Georgetown, IN (US) 47122

( * ) Notice: Subject to any disclaimer, the term of this patent is extended or adjusted under 35 U.S.C. 154(b) by 38 days.

(21) Appl. No.: 11/363,759

(22) Filed: Feb. 28, 2006

(65) Prior Publication Data

US 2007/0212036 A1 Sep. 13, 2007

(51) Int. Cl.
*F24H 1/20* (2006.01)

(52) U.S. Cl. ..... 392/451; 392/497; 219/548

(58) Field of Classification Search ..... None
See application file for complete search history.

(56) References Cited

U.S. PATENT DOCUMENTS 3,564,199 A * 2/1971 Blaha ..... 219/205
3,683,361 A * 8/1972 Salzwedel et al. ..... 338/322
3,860,787 A * 1/1975 Strobach ..... 392/457
3,878,362 A * 4/1975 Stinger ..... 219/528
4,156,127 A * 5/1979 Sako et al. ..... 392/480
4,534,886 A * 8/1985 Kraus et al. ..... 252/502
5,229,582 A * 7/1993 Graham ..... 219/541
5,713,864 A * 2/1998 Verkaart ..... 604/113
6,483,087 B2 * 11/2002 Gardner et al. ..... 219/545
2006/0098964 A1 * 5/2006 Haubold et al. ..... 392/447

* cited by examiner

*Primary Examiner*—Thor Campbell
(74) *Attorney, Agent, or Firm*—Kile Goekjian Reed & McManus PLLC; Bradford Kile, Esq.

(57) ABSTRACT

An electric fluid or water heater is shown in which the heat generation is accomplished by a non-metallic element. The heating element exploits properties of carbon black based polymers. These basic elements have both electrically conductive and electrically restive properties. Metal strips are injection molded into the carbon black body of the heating element with physical contact between the metal and the carbon black. When current is passed through the metal strips, the resistivity of the carbon black causes heat to be generated. Prior art metal heating elements are subject to corrosion and degradation of performance over time. In addition, the inflow and outflow pipes may be constructed in the same manner to heat fluid en route.

8 Claims, 7 Drawing Sheets

NON-METALLIC HEATING ELEMENT FOR USE IN A FLUID HEATER

BACKGROUND OF THE INVENTION

This invention relates to a heating element for use in a fluid heater. More specifically, this invention relates to a non-metallic heating element that is not susceptible to corrosion. This heating element may be inside the housing of a fluid heater and/or constitute the pipes that input fluid to and output fluid from the heater.

In the prior art, the storage-type fluid heater is comprised of a metallic or the less common plastic container. This describes the vast majority of vessels that are used for the purpose of heating a fluid. The source energy to raise the temperature of the fluid, within the container, to its desired predetermined level, the temperature setpoint, may be electric, combustible petroleum, or combustible gas. Regardless of the energy source the prior art has shown that metal(s) have been used to contain and apply heat to the fluid. This use of metal in constant contact with water has led to negative results. Specifically, the metallic heating elements are subject to failure due to corrosion. This corrosion is facilitated by the mineral build up within the base of the metallic storage tank as well as direct adherence to the internal metallic heating elements. The mineral build up is caused by the continuous heating of a fluid, such as water, under relatively low pressures and then having that hot fluid remain stagnant. This internal state of the fluid heating tank allows minerals to precipitate out of the fluid, to build up on the base of the tank, and to form onto the protruding internal electrical heating elements.

Fluid heaters that are heated by natural gas typically comprise a vertical, cylindrical tank having a centrally located gas flue passing vertically through the tank. The radial flame gas burner is located below the bottom of the metallic tank. This burner heats the water in the tank. Additionally heat is transferred to water in the tank from hot combustion gasses produced by the burner passing upward through the gas flue. Flue baffles and similar apparatuses are commonly employed in the gas flue for improving heat transfer from the combustion gases to the water in the tank. Combustion gases are exhausted from the gas flue near the top of the tank.

Fluid heaters that are electrically heated generally comprise a vertical cylindrical metallic or in this case a non-metallic tank having one or more electrical resistance heating elements mounted at intermediate elevations in the water tank. Heat is exchanged between the metallic heating elements and water in the tank.

Prior art attempts to resist corrosion included the placement of an anode within the tank. The anode is a metal rod usually made of magnesium or aluminum. Electrolysis eats away the metal anode instead of the other metal (heating elements or walls) of the tank. The benefit of this is limited, however, because once the anode is exhausted, the tank itself begins to corrode. Another deficiency found in prior art electric type fluid heaters is a reduction in heating efficiency due to the mineral content of the water. When water is heated under pressure, minerals will precipitate out of the water and adhere to the electric heating elements thus reducing their efficiency and eventually promoting their failure. Those deposits will also form into larger crystals and remain on the bottom of the tank; this is particularly troublesome for flame producing heaters, since the heat must transfer through large deposit layers.

The average life of a residential storage type water heater is about 13 years. The corrosion of the heating elements and tank of the heater can decrease the operating time and negatively impact performance during its functioning life.

The difficulties and limitations suggested in the preceding are not intended to be exhaustive, but rather are among many which demonstrate that although significant attention has been devoted to decreasing the amount of corrosion within fluid heaters and their resulting decreased function, the prior attempts do not satisfy the need for long term stability of the fluid heater.

OBJECTS OF THE INVENTION

It is therefore a general object of the invention to provide a fluid heating apparatus that will meet the objectives and minimize limitations of the type previously described.

It is a specific object of the invention to provide a heating element for use in a fluid heating system that is not susceptible to corrosion.

It is another specific object to provide a fluid heating system having pipes capable of heating incoming and outgoing fluid and also not being susceptible to corrosion.

BRIEF SUMMARY OF A PREFERRED EMBODIMENT OF THE INVENTION

In order to provide a solution to the deficiencies of the prior art, a preferred embodiment of the present invention provides a non-metallic heating element for use in a fluid heater. The heating element comprises a carbon black body that fully encases a set of one or more thin, flat metal strips. When a voltage is applied to the flat metal strips, a current is passed through the carbon black to the next strip, the resistance of the carbon black body produces heat for changing the fluid temperature.

THE DRAWINGS

Objects and advantages of the present invention will become apparent from the following detailed description of embodiments taken in conjunction with the accompanying drawings, wherein.

Figure 5A:
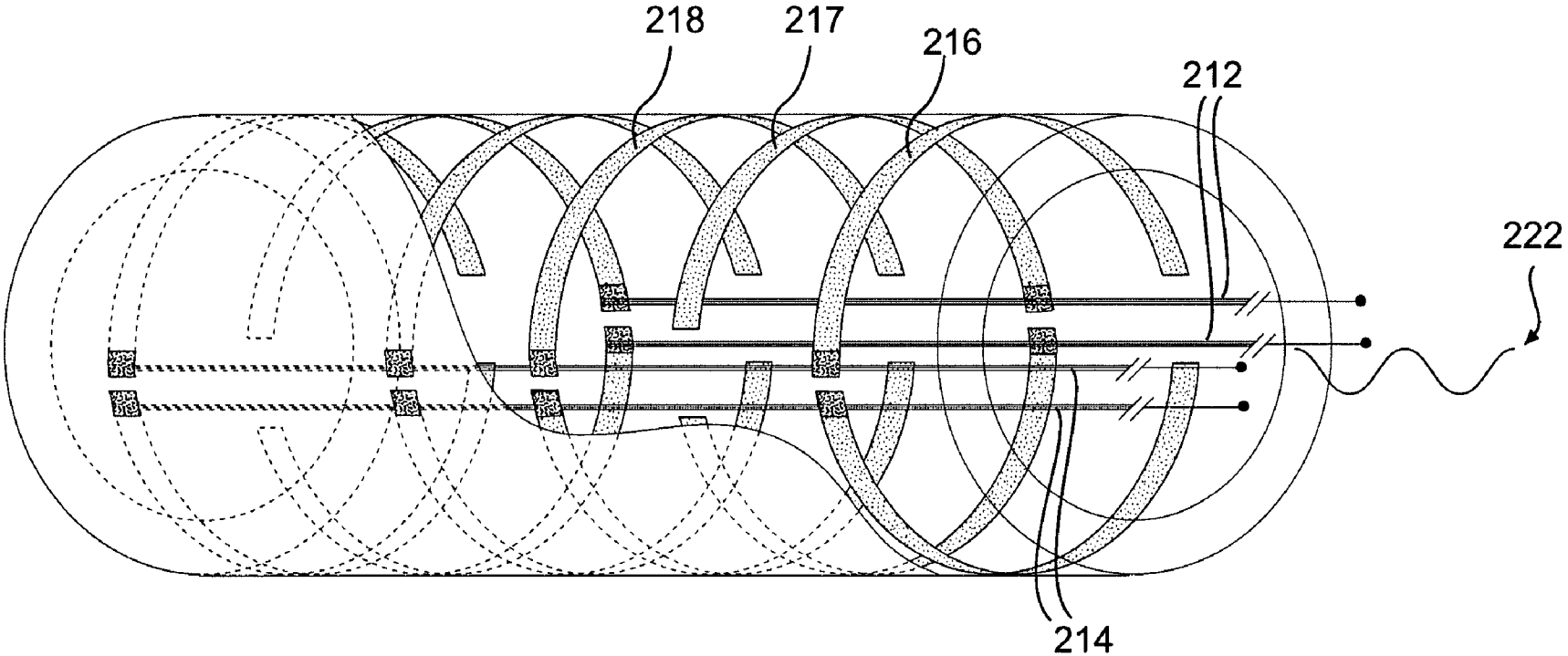

FIG. 5*a* is a schematic view of the heating element formed into a pipe.

Figure 5B:
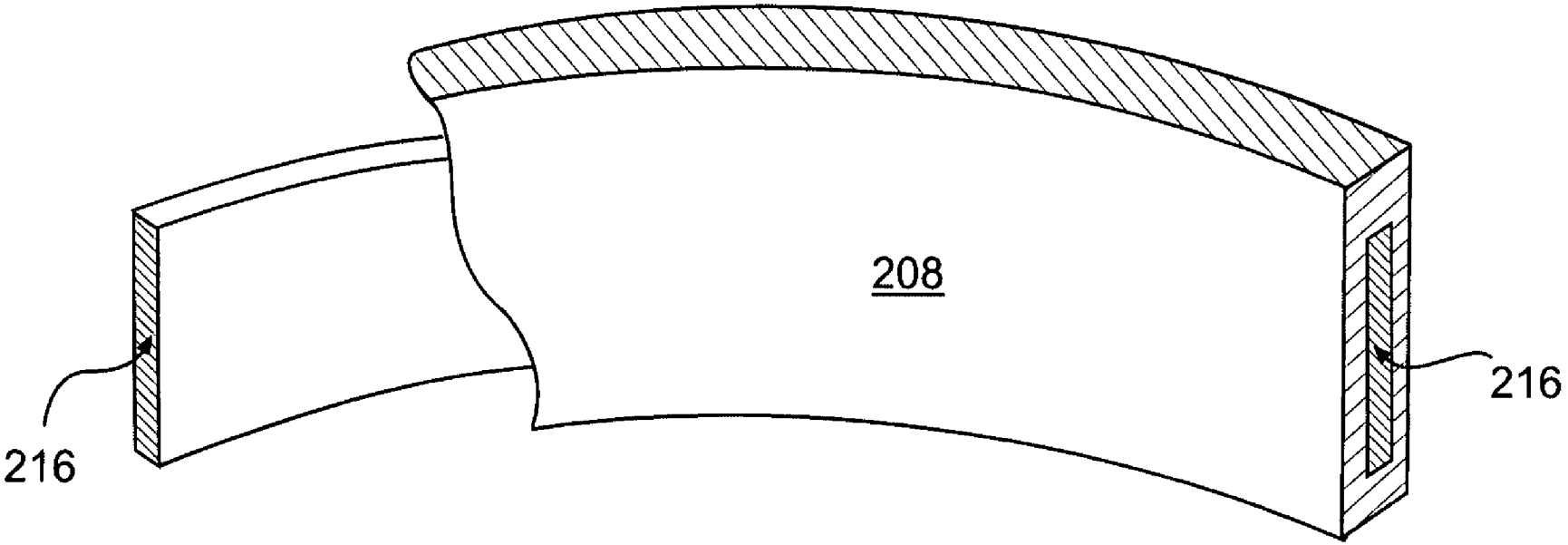

FIG. 5*b* is a cross sectional view of a portion of the pipe to show detail.

Figure 6:
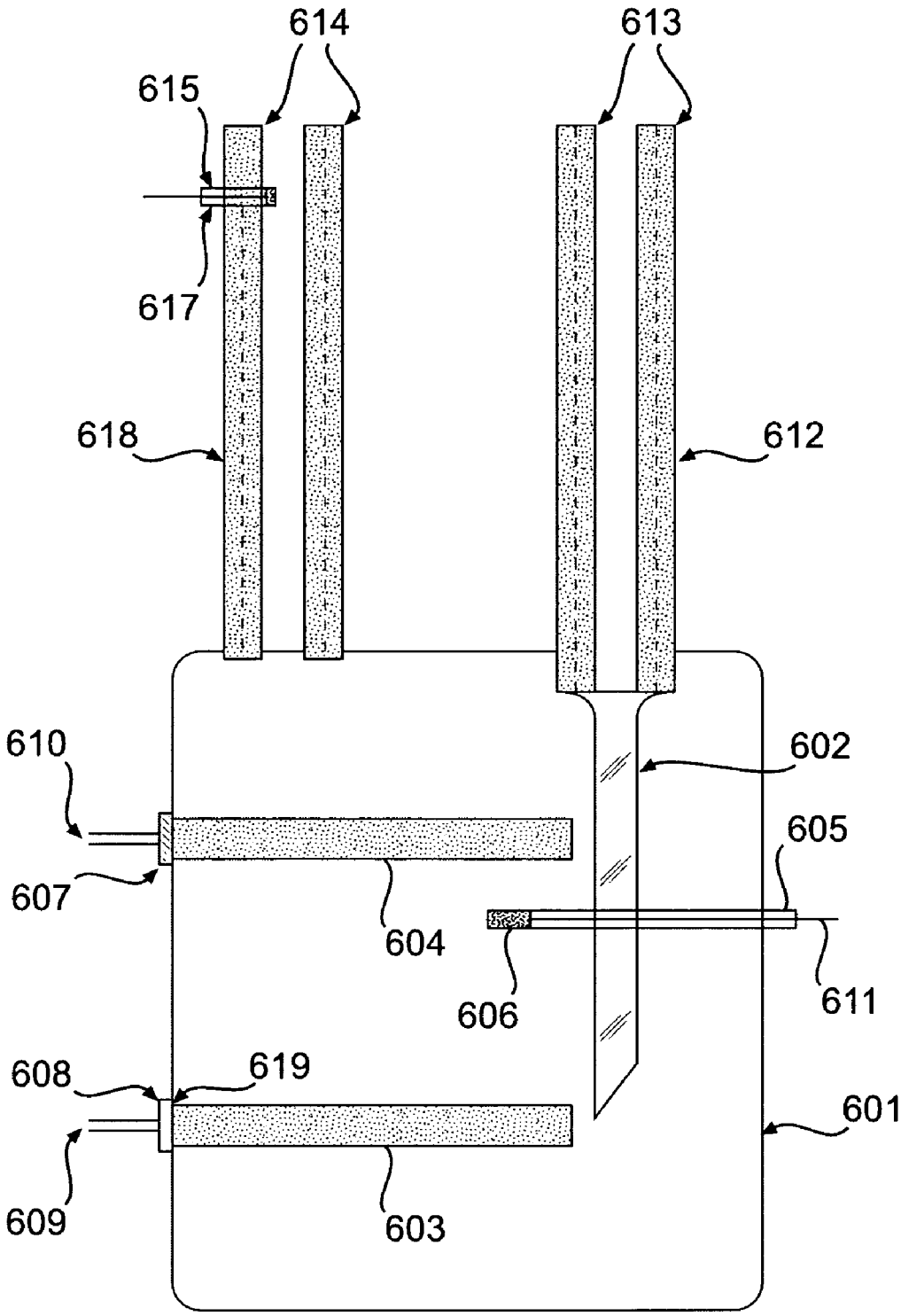

FIG. 6 is a cross sectional of the fluid heater using the heating elements of the invention.

DETAILED DESCRIPTION

Carbon black is a generic term for the family of colloidal carbons. More specifically, carbon black is made by the partial combustion and/or thermal cracking of natural gas, oil, or another hydrocarbon. The incorporation of carbon black into polymers and the process for this incorporation is known in the art. Specifically, conductive fillers have been incorporated into polymers to make them electrically conductive with carbon black being the most common. In a preferred embodiment, the resistivity to alternating current is critical to generating heat by creating an electrical field internal to the surrounding carbon black material.

The heating element of a preferred embodiment ideally contains a centrally located pattern of direct conductors. The direct conductors are flat copper ribbon spaced and centered within the heating panel. The copper is a useful transmitting medium for an alternating current regardless of its frequency.

The copper tape is introduced to the carbon black body of the heating element via insert molding. Insert molding is an injection molding process whereby the carbon black polymer is injected into a cavity and around an insert piece placed into the same cavity just prior to molding. The result is a single piece with the insert encapsulated by the carbon black polymer. The insert of a preferred embodiment is a length of twenty (20) gauge copper tape (0.2500 inch width).

The insert molding technique was initially developed to place threaded inserts in molded parts and to encapsulate the wire-plug connection on electrical cords. Today insert molding is used quite extensively in the manufacture of medical devices. Typical applications include insert-molded encapsulated electrical components and threaded fasteners. Generally, there are few design limitations or restrictions on material combinations.

Another reason for the use of insert molding within a preferred embodiment is due to the type of bonding that will occur between the carbon black polymer and the copper tape conductor. There are two types of bonding that occur in insert molding: molecular and mechanical. Mechanical bonding is the only feasible option due to the dissimilar characteristics of the carbon black polymer and the copper tape electric conductor. The mechanical bonding of insert mold can take place in two forms. The first is the shrinking of the encapsulating carbon black polymer around the copper tape as the resin cools. In the second (the one implemented in the preferred embodiment), irregularities will be placed upon the surface of the copper tape to create a rough surface prior to any molding. This is done to facilitate the mechanical bond of the copper tape to the surrounding carbon black polymer. Although shrinkage of the carbon black polymer will occur, it alone is generally not sufficient to produce adequate physical strength or leak resistance of the copper tape conductor. In general, when insert molding dissimilar materials, the insert should offer some means of mechanical retention such as a rough surface.

The concept of the heating element is extended to the input and output fluid pipes servicing the fluid heater. These pipes are constructed in the same manner as the solid heating element, but they are molded to have a hollow center for the passage of water or other fluid. By applying current to the copper strips encased in the body of the pipe, the water can be heated as it moves in or out of the storage tank to increase efficiency.

The non-metallic heating elements described are not susceptible to corrosion as are the metal parts of prior art fluid heaters. As such, this will lead to longer life and better performance of the final product.

Figure 1:
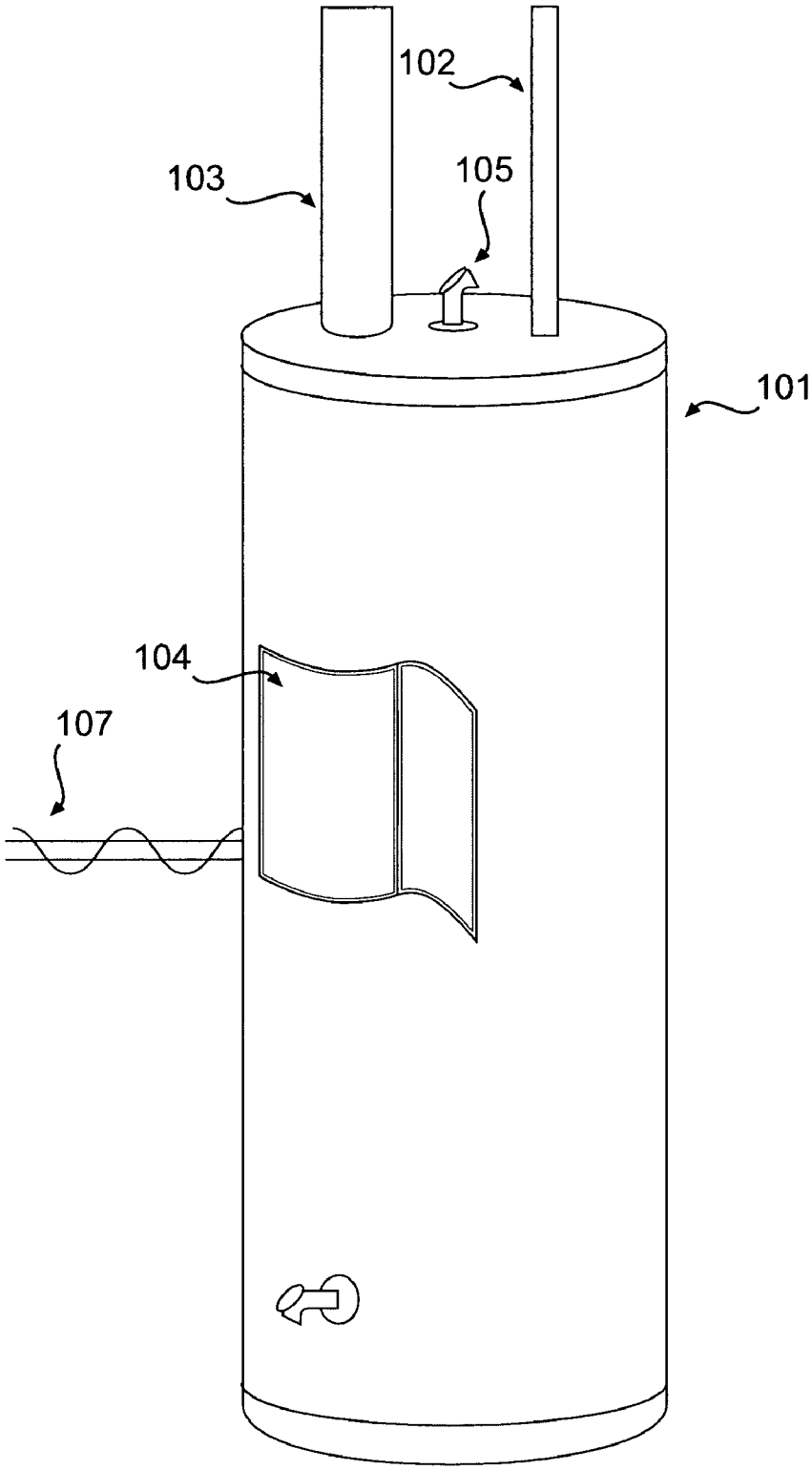
FIG. 1 is a schematic view of the fluid heater in which the present invention can be used.

Referring now to FIG. 1, an exterior view of a fluid heater is depicted including cylindrical tank 101. This type of tank is typical of those found in common household water heaters and is used for the description of a preferred embodiment. However, the invention is not limited to such a design as that of FIG. 1. The fluid to be heated is introduced to the tank through the heated fluid input pipe 102. Pipe 102 is preferably constructed of carbon black as described herein (although it may be metal) and interfaces with a dip tube that introduces the incoming fluid to the bottom of the tank. Element 104 is a side mounted power input and mode control unit. The mode control unit functions to provide the user a selectable fluid setpoint temperature, automatically place the unit in a low temperature mode, recover from that low temperature mode, and provide continuous heated fluid operation when requested by the user. Pressure relief valve 105 provides a safe outlet for the heated fluid when the expansion of that fluid results in an increase of pressure that, if not vented, could lead to tank rupture. Service drain valve 106 is used to remove all fluid from the tank when necessary for repairs or monitoring. Element 107 shows the input of alternating current to the into the mode control unit 104. Outflow pipe 103 is also preferably constructed of the same carbon black polymer as the tank heating element.

Figure 2:
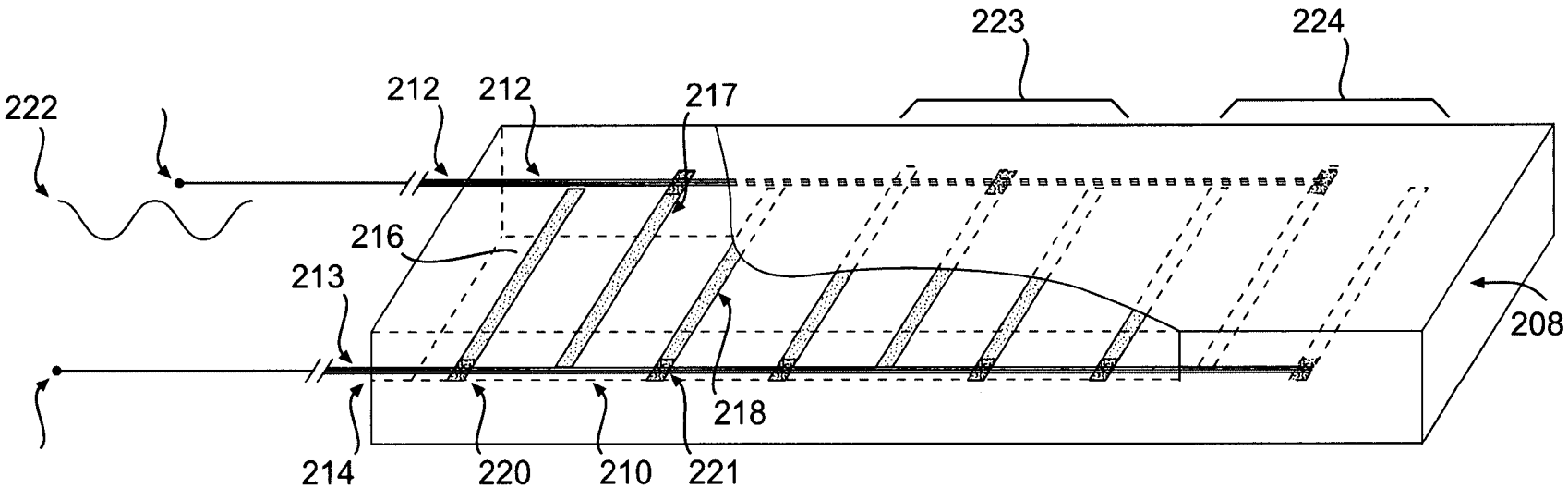
FIG. 2 is a schematic view of the heating element.

Turning to FIG. 2, a cutaway view of heating element 108 is shown. The element is shown in a rectangular form here, but could be changed in general shape to fit the size and form of the fluid heater. The conductor embedded in the heating element cannot protrude through the surface of the carbon black heating element and is preferred to be positioned a minimum of 6.35 mm from any surface of the heating element.

The carbon black polymer of the heating element 208 is insert molded around copper conductors 216, 217, and 218 as described above. The preferred copper tape is of twenty (20) gauge copper having a width of 6.35 mm (0.25"). The tapes are generally spaced approximately 5.1 cm (2") for optimal performance. This spacing may vary depending on the width of the tape and current that is used. Before injection molding, at least one surface of the copper tape is distressed. Two fourteen (14) gauge copper conductor wires 210 and 211 are attached to the copper tape by soldering, mechanical connection, or other suitable connection type. This connection is made at the intersection of the copper wire and the copper tapes shown at points 219, 220, and 221. The copper tapes 216, 217, and 218 are a set of three that are arranged in a pattern that repeats throughout the length of the heating element. The single copper tape 217 is attached to the line side of the input current. This tape is bordered on each side by tapes 216 and 218 which are both connected to the load side of the input current. Current is naturally going to flow from the line to the load side, so current will tend to flow from strip 217, through the carbon black material, to both strips 216 and 218. The resistance of the carbon black material to the current is what generates heat and allows the element to operate. This three tape configuration is repeated with the groups of tape labeled 223 and 224. This three tape configuration is referred to as a heat generation array. Connecting wires 210 and 211 are insulated at points 212 and 213 where they exit from the carbon black heating element wall. They are also insulated at points 214 and 215 where they pass through the wall.

Figure 3:
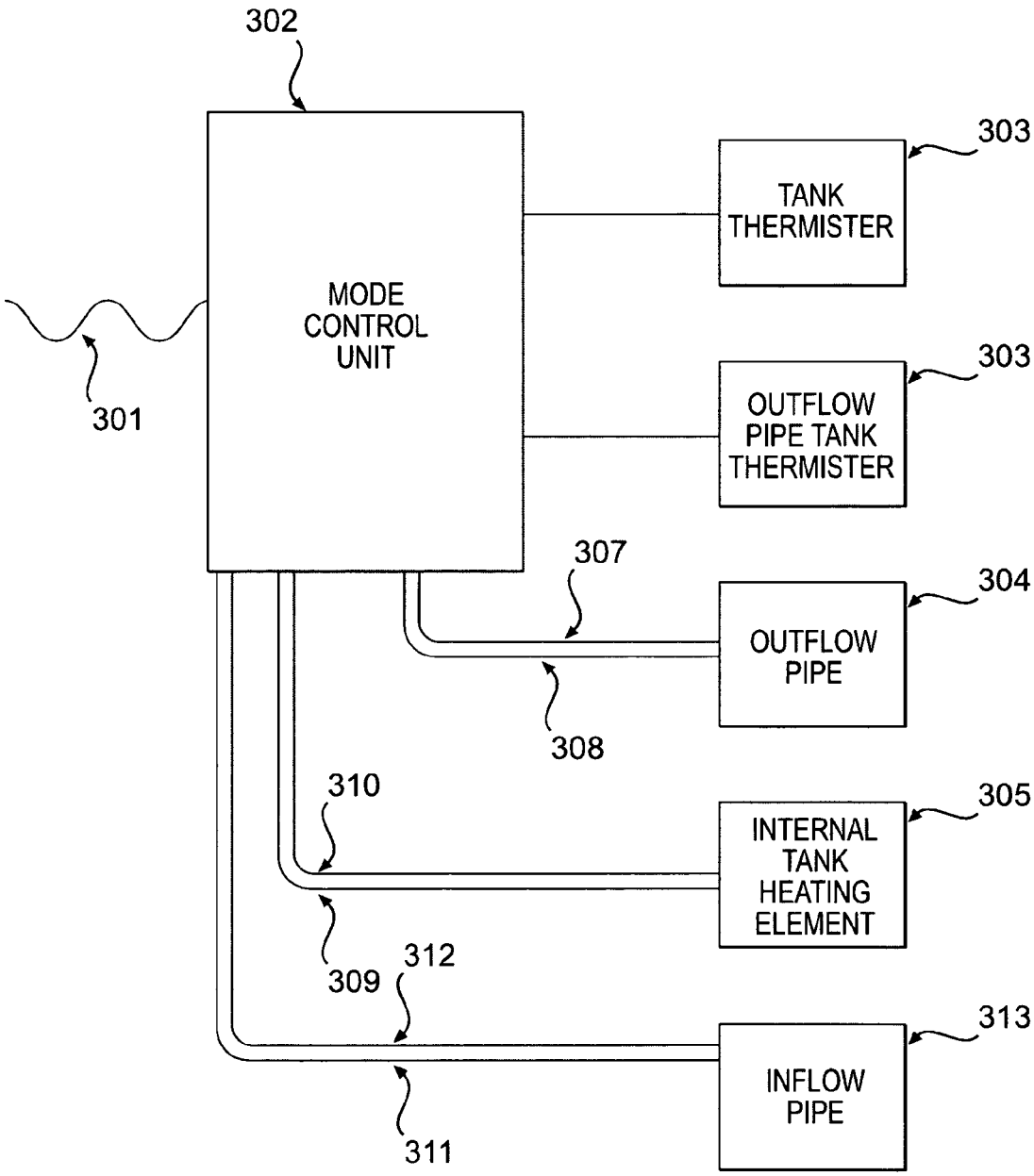
FIG. 3 is a block diagram of the major components of the fluid heater.

FIG. 3 is a block diagram of the major components that are controlled by the mode control unit 302. Alternating current 301 provides power to the mode control unit 302. The current passed to any carbon black heating element will be controlled by the mode control unit 302. Tank thermistor 303 is positioned through the exterior wall of the fluid tank and held within the confines of the tank in direct contact with the fluid for the purpose of measuring the temperature of the fluid. Likewise, outflow pipe thermistor 304 penetrates the heated carbon black fluid outflow pipe 305 and is in direct contact with the fluid flowing through it. The outflow pipe 305 is provided current via the line side 307 and the load side 308 of the input alternating current 301. The outflow pipe heating element will only be actively heating when the mode control unit 302 closes the switch or relay that completes the circuit of alternating current transmitted via wire pair 307 and 308. Tank heating element 306 is supplied alternating current via line side 309 and load side 310. As above, this heating element will become active only when the mode control unit 302 closes a switch or relay that will complete the circuit. The inflow pipe 313 is also constructed in the same manner as the heating element and is active when mode control unit 302 closes a switch or relay. Wire pair 311 (load) and 312 (line) provide the alternating current.

Figure 4:
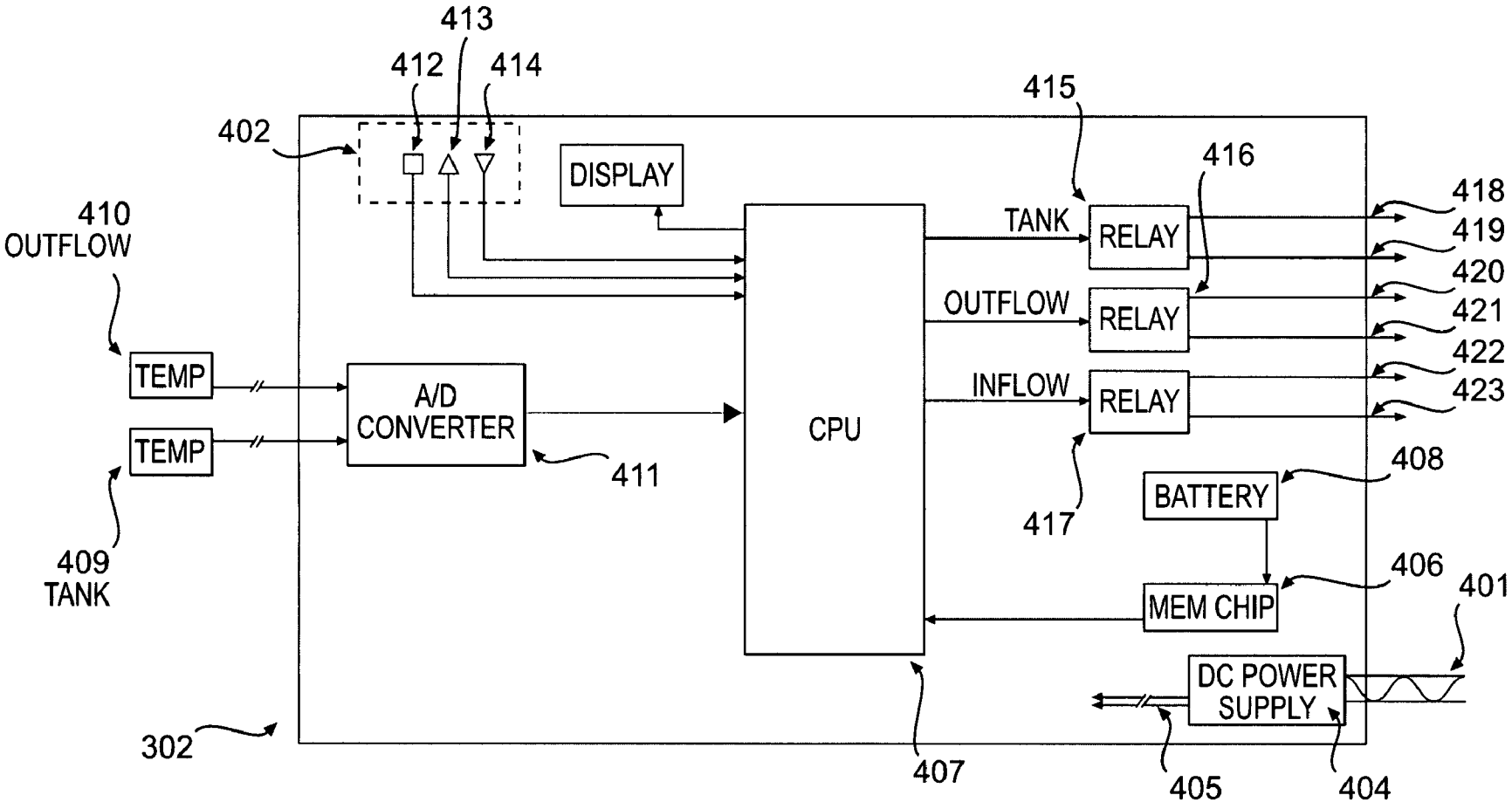
FIG. 4 is a block diagram of the components of the mode control unit.

FIG. 4 shows the internal components of mode control unit 302. Alternating current source 401 provides power to the one or more controlling circuit(s) via the DC Power Supply 404 as well as controlling the supply of the alternating current to the carbon black heating element(s). The microprocessor and firmware 407 controls all functions of the fluid heater. Each of the outputs of the mode control unit 302 to each of the tank heating elements or heated pipes is either in a state of on or off. The switches 415, 416, and 417 will switch on the alternating current only when the fluid temperature read by thermistors 409 and 410 crosses the setpoint temperature. For fluid heating control, the output is on when the temperature is at or below the setpoint temperature and off when above the setpoint temperature.

The mode control unit 302 has an alphanumeric digital display 403 that is visible to the user. The alphanumeric display will show the operating mode as well as allow the user to view and change the setpoint temperature. The mode control unit control panel 302 comprises three momentary on pushbutton switches. The first pushbutton switch 412 toggles between normal operating mode and setpoint temperature setting mode. Pushbutton switch 413 is the positive temperature increment switch, when pressed, it will cause the setpoint temperature to rise by one degree. Pushbutton switch 414 is the temperature decrement switch which will lower the setpoint temperature by one degree when pressed. After the user has selected the desired setpoint temperature, the mode select pushbutton 412 is pressed to return the mode control unit 302 to the normal operating mode. The mode control panel 302 communicates to the central processing unit (CPU) 407, a dedicated application microprocessor. This CPU communicates with the mode control display 403 and generates the alphanumeric characters. The CPU 407 stores its variable instructions within a battery backed up memory chip 406 whose purpose is to ensure that the setpoint temperature is not lost if the main power source is lost due to a power outage. The CPU 407 receives the current fluid temperature from two locations, thermistor 409 in the outflow pipe and thermistor 410 in the storage tank. The thermistors transmit the current analog fluid temperature to the analog to digital converter 411. The converter 411 converts the analog temperature value to a digital value that can be used by CPU 407.

Normal operating mode of a preferred embodiment occurs during times of active user demand for heated fluid, typically water. The CPU 407 determines normal operations when the tank fluid temperature is below the user defined setpoint temperature and less than 30 minutes have elapsed since closure of the main tank switch 415 (this switch causes heating of the tank fluid). This short time period between closures of the switch indicates that there is a high demand for hot water from the storage tank. When this condition is met, switch 415 is closed and alternating current flows to the carbon black heating element via wires 418 and 419. If the tank utilizes heated pipes, CPU 407 will simultaneously close switch 417 sending alternating current to the heated inflow pipe via wires 422 and 423.

Another mode is a low temperature mode and it occurs if the fluid in the storage tank has not reduced temperature for a period of thirty minutes since the last closure of switch 415. In this instance, CPU 407 will allow the temperature of the fluid in the tank to decrease by a predetermined amount. In a preferred embodiment, this predetermined amount is forty degrees lower than the setpoint temperature. This lower temperature state will continue until the introduction of fluids colder than the predetermined low temperature. When these fluids are introduced, the CPU 407 signals the switch 415 to close, sending alternating current to the tank internal heating element. At the same time, if heated pipes are in use, CPU 407 will close switches 416 and 417 to send alternating current to both the inflow and outflow pipes via wires 420, 421, 422, and 423. In this situation, the CPU will monitor the temperature of the fluid in the outflow pipe and maintain this fluid at the user setpoint. In doing this, the end user will not experience colder water due to the tank being in low temperature mode. CPU 407 does this by turning on and off the switch 416 that controls alternating current being sent to the outflow pipe. This is possible due to the relatively small internal diameter of the outflow pipe and the limited rise in temperature required given that the fluid has been heated above its lowest temperature before entering to the outflow pipe. The CPU 407 will only stop the flow of alternating current to the outflow pipe and tank heating element when the tank fluid temperature reaches the user defined setpoint temperature thus ending the low temperature cycle and beginning a new thirty minute time period.

It is advantageous in some implementations to heat fluid as it is input into the fluid heater and as it exits the tank. In order to accomplish this, a pipe can be constructed using carbon black and inserting copper tape as described in relation to FIG. 2. FIG. 5*a* shows this structure. The carbon black body is formed into a pipe that fluid can flow through. Element 217 is a strip of copper tape that is attached to the line side 212 of input alternating current 222. Copper strips 216 and 218 are attached to the load side 214 of the input alternating current 222. The current that traverses through the carbon black generates heat as described above and can be used to heat incoming or outgoing fluid. FIG. 5*b* is a cutaway portion of the pipe shown in FIG. 5*a*. This figure illustrates that electrical conductor 216 is fully embedded in the carbon black body 208. All the electrical conductors are similarly embedded in the carbon black body.

FIG. 6 is a cross sectional view of a cylindrical type tank of a preferred embodiment constructed of either metal or plastic. Cold fluid is input into the storage tank via the input pipe 612. Input pipe 612 is preferably constructed of carbon black and injection molded around copper tape to perform the heating functions described herein. The length of input pipe 612 is proportional to the volume of fluid the tank is designed to heat. Fluid heaters as commonly installed have an input pipe no less than 1 meter in length and no greater than 2 meters. The heated outflow pipe 618 is constructed to the same dimensions as 612. Water flows to the outflow pipe due to the constant pressure in the tank. Input pipe 612 is directly connected to dip tube 602. This dip tube causes the cold water to be introduced to the bottom of the tank 601. The dip tube is typically made of plastic and physically connected to the input pipe 612. The dip tube may have a series of slits in its body to facilitate better mixing of the incoming fluid. The carbon black heating elements 603 and 604 are constructed as described herein and inserted into the tank via mated flange openings 619 and 620. The heating element 603 is affixed to flange 608 using an aircraft grade epoxy such as STYCAST 2651 BLACK manufactured by Emerson & Cuming, Billerca, Mass. USA. The flange/heating element assembly is bolted to the tank after it is inserted through the opening 619. The watertight seal of the flange 608 retains the structural integrity of the tank withstanding a pressure up to the tank's rating, nominally 300 lbs/in$^2$. Sealed and insulated wire pair 609 penetrates the flange 608 and carries alternating current controlled by mode control unit 302. Heating element 604 is constructed and affixed in the same manner as element 603 using flange 607 through opening 620 with wire pair 610. Thermistor 606 is inserted into the tank via wall sleeve 605. Wire lead 611 connects thermistor 606 to the mode control unit 302 and CPU 407 via the digital to analog converter 411 as described above. Thermistor 606 is positioned inside the tank near its center in order to allow it to read the fluid temperature.

Thermistor 616 is inserted into outflow pipe 618 via wall sleeve 615. Wire lead 617 connects thermistor 616 to the mode control unit 302 and CPU 607 via the digital to analog converter 411.

In describing the invention, reference has been made to preferred embodiments and illustrative advantages of the invention. The subject invention, however, is not limited to residential water heaters. Those skilled in the art and familiar with the instant disclosure of the subject invention may recognize additions, deletions, modifications, substitutions, and other changes which fall within the purview of the subject invention and claims.

SUMMARY OF MAJOR ADVANTAGES OF THE INVENTION

After reading and understanding the foregoing detailed description of an inventive fluid heating apparatus in accordance with preferred embodiments of the invention, it will be appreciated that several distinct advantages of the subject fluid heating apparatus are obtained.

At least some of the major advantages include providing a body 208 made of carbon black and encasing in this body a plurality of metal strips 216, 217, and 218 by injection molding. A portion of the strips are connected to line side 212 of the input alternating current 222. These strips are bordered on each side by strips connected to the load side 214 of input alternating current 222. When a voltage is applied, current tends to flow from the strip connected to the line side, to the strips connected to the load side. The resistance to this current produces heat. This is advantageous because heat is generated and no metal is in contact with the fluid so corrosion is avoided.

What is claimed is:

1. A fluid heater comprising:

a fluid storage tank;

a fluid input pipe operably connected to said fluid storage tank;

a fluid output pipe operably connected to said fluid storage tank;

a power input and mode control unit operably connected to said fluid storage tank;

a pressure release valve operably connected to said fluid storage tank;

a service drain valve operably connected to said fluid storage tank;

a temperature meter operably connected to said fluid storage tank for determining a fluid temperature in said fluid storage tank;

an alternating current source connected to said power input; and at least one heating element operably connected to said fluid storage tank comprising:

a carbon black body;

a first set of metal members having an upper surface and a lower surface encased in said body;

an electrical input providing alternating current and having a line side and a load side;

a portion of said first set of metal members being physically connected to said line side and the remainder of said plurality of metal members being physically connected to said load side; and electrical current being applied by said electrical input causing current to flow from metal members connected to said line side to metal members connected to said load side;

wherein said fluid input pipe comprises:

a carbon black body formed into a tube;

a second set of one or more metal members having an upper surface and a lower surface fully encased in said body;

an electrical input providing alternating current and having a line side and a load side;

a portion of said second set of metal members being physically connected to said line side and the remainder of said second set of metal members being physically connected to said load side; and electrical current being applied by said electrical input causing current to flow from metal members connected to said line side to metal members connected to said load side.

2. The fluid heater as defined in claim 1 wherein:

said second set of one or more metal members comprises strips of copper tape.

3. The fluid heater as defined in claim 2, wherein:

irregularities are imposed on at least one of said upper surface and said lower surface of each of said first and second sets of one or more metal members.

4. A fluid heater comprising:

a fluid storage tank;

a fluid input pipe operably connected to said fluid storage tank;

a fluid output pipe operably connected to said fluid storage tank;

a power input and mode control unit operably connected to said fluid storage tank;

a pressure release valve operably connected to said fluid storage tank;

a service drain valve operably connected to said fluid storage tank;

a temperature meter operably connected to said fluid storage tank for determining a fluid temperature in said fluid storage tank;

an alternating current source connected to said power input; and at least one heating element operably connected to said fluid storage tank comprising:

a carbon black body;

a first set of metal members having an upper surface and a lower surface encased in said body;

an electrical input providing alternating current and having a line side and a load side;

a portion of said first set of metal members being physically connected to said line side and the remainder of said plurality of metal members being physically connected to said load side; and electrical current being applied by said electrical input causing current to flow from metal members connected to said line side to metal members connected to said load side;

wherein said fluid output pipe comprises:

a carbon black body formed into a tube;

a third set of one or more metal members having an upper surface and a lower surface fully encased in said body;

an electrical input providing alternating current and having a line side and a load side;

a portion of said third set of metal members being physically connected to said line side and the remainder of said third set of metal members being physically connected to said load side; and electrical current being applied by said electrical input causing current to flow from metal members connected to said line side to metal members connected to said load side.

5. The fluid heater as defined in claim 1 wherein:

said third set of one or more metal members comprises strips of copper tape.

6. The fluid heater as defined in claim 5, wherein:

irregularities are imposed on at least one of said upper surface and said lower surface of each of said first and third sets of one or more flat metal strips.

7. The fluid heater as defined in claim 1, wherein:

when said temperature meter senses a preset temperature, electrical current is applied to said second set of one or more flat metal strips.

8. The fluid heater as defined in claim 4, wherein:

when said temperature meter senses a preset temperature, electrical current is applied to said third set of one or more flat metal strips.

* * * * *